US006347489B1

(12) United States Patent
Marshall, Jr. et al.

(10) Patent No.: US 6,347,489 B1
(45) Date of Patent: Feb. 19, 2002

(54) STORM ANCHOR SYSTEM INCLUDING FOUNDATION COLUMN WITH ADJUSTABLE SADDLE-TYPE POSITIONING MEMBERS

(75) Inventors: Chester R. Marshall, Jr., 485 Hampshire Rd., Akron, OH (US) 44313; James D. McCue, Sagamore Hills, OH (US)

(73) Assignee: Chester R. Marshall, Jr.

( * ) Notice: Subject to any disclaimer, the term of this patent is extended or adjusted under 35 U.S.C. 154(b) by 0 days.

(21) Appl. No.: 09/677,793

(22) Filed: Oct. 2, 2000

Related U.S. Application Data

(62) Division of application No. 09/301,902, filed on Apr. 29, 1999.

(60) Provisional application No. 60/083,970, filed on May 1, 1998.

(51) Int. Cl.[7] ..... E02D 35/00; E02D 5/80

(52) U.S. Cl. ..... 52/169.9; 52/126.6; 52/143; 52/DIG. 11; 248/354.5

(58) Field of Search ..... 52/169.9, 126.6, 52/DIG. 11, 143; 248/122.1, 124.1, 188.4, 354.5, 100, 228, 228.1, 228.3, 228.5, 316.4, 316.8; 254/419, 16, 30, 99, 100, 102

(56) References Cited

U.S. PATENT DOCUMENTS

| | | | | |
|---|---|---|---|---|
| 692,179 | A | | 1/1902 | Callahan |
| 1,719,528 | A | | 7/1929 | Beckley et al. |
| 1,796,173 | A | | 3/1931 | Warren |
| 1,948,600 | A | | 2/1934 | Templeton |
| 2,115,824 | A | | 5/1938 | McRorey |
| 2,664,977 | A | | 1/1954 | Starcevich |
| 3,222,030 | A | | 12/1965 | Thorpe |
| 3,371,902 | A | | 3/1968 | Hartwick |
| 3,415,490 | A | | 12/1968 | Steele |
| 3,655,161 | A | | 4/1972 | Schueler |
| 3,797,793 | A | | 3/1974 | Moritz et al. |
| 3,802,658 | A | | 4/1974 | Binding |
| 4,025,053 | A | | 5/1977 | Stickle, Jr. |
| 4,067,448 | A | | 1/1978 | Bergeron, Jr. |
| 4,438,607 | A | | 3/1984 | Nelson |
| 4,546,581 | A | | 10/1985 | Gustafson |
| 4,562,673 | A | | 1/1986 | Barari |
| 4,614,070 | A | * | 9/1986 | Idland ..... 52/296 |
| 4,738,061 | A | * | 4/1988 | Herndon ..... 52/126.6 |

(List continued on next page.)

*Primary Examiner*—Carl D. Friedman
*Assistant Examiner*—Phi Dieu Tran A
(74) *Attorney, Agent, or Firm*—Fay, Sharpe, Fagan, Minnich & McKee, LLP

(57) ABSTRACT

A foundation column is provided far supporting an associated housing structure relative to an associated foundation base. The foundation column includes a vertical elongate main body member, a substantially flat cap plate member disposed on the upper end of the main body member, and a pair of spaced apart wall members carried by the cap plate member on opposite sides of the longitudinal axis defined by the main body member. The pair of wall members are selectively movable relative to the cap plate member to receive associated housing structures of various sizes in the space formed between the pair of wall members. Two such foundation columns are combined together with a pair of lateral attachment members to form a corner anchor system. The first and second foundation columns are connected to the first and second lateral attachment members using first and second diagonal strut members, respectively. A cross-brace type anchor system is provided for connecting parallel structural support beams to a foundation base using a pair of foundation columns under each beam and further including lateral and transverse connections between the parallel beams. Foot plate members serve as an interface between the column posts and the associated foundation base and are used as templates for setting anchor studs in predetermined arrangements in the associated foundation base.

23 Claims, 8 Drawing Sheets

U.S. PATENT DOCUMENTS 4,866,797 A * 9/1989 Vollan ..... 52/126.6
4,882,887 A 11/1989 Giles et al.
4,895,335 A 1/1990 Oliver
5,056,750 A 10/1991 Ellithorpe
5,098,066 A 3/1992 Willcox, III
5,150,557 A 9/1992 Gregory
5,212,919 A 5/1993 Shaw et al.
5,412,914 A 5/1995 Daw et al.
5,501,754 A 3/1996 Hiraguri
5,509,237 A * 4/1996 Coulter ..... 52/126.6
5,515,655 A 5/1996 Hoffmann
5,516,066 A 5/1996 Fabiano et al.
5,560,160 A 10/1996 Vladikovic
5,561,950 A 10/1996 Collins et al.
5,680,732 A 10/1997 Skouras
5,839,239 A 11/1998 Jang
5,862,635 A * 1/1999 Linse et al. ..... 52/126.6

* cited by examiner

STORM ANCHOR SYSTEM INCLUDING FOUNDATION COLUMN WITH ADJUSTABLE SADDLE-TYPE POSITIONING MEMBERS

This application claims the benefit of is a divisional application of U.S. Application Ser. No. 09/301,902 filed Apr. 29, 1999 which claimed the benefit of U.S. Provisional application Ser. No. 60/083,970, filed May 1, 1998.

BACKGROUND OF THE INVENTION

The subject invention is directed toward the art of support columns and anchor posts and, more particularly, to fabricated structural support assemblies consisting of adjustable columns, lateral stabilizing braces, and anchor plates that function as adjustable support piers and storm anchors, providing substantial positive (downward), negative (upward), and transverse (sideways) load resistance to the supported structure in both major horizontal and vertical directions. The invention is further directed to an improved adjustable foundation column having a pair of upper saddle-type positioning members in the form of opposing walls on the column end that can be adjusted to adapt the top end of the support column to engage overhead load members of various sizes and widths.

The invention is especially well suited for use as a structural member to transfer axial compressive loads as well as lateral offsetting loads from steel or wood beams integrated into the underside of a structure to concrete footers, grade beams or foundation pads and will be described with particular reference thereto. However, those skilled in the art will recognize that the invention has other broader uses such as, for example, use as an anchor assembly or device to connect objects other than buildings or structures, such as industrial equipment and the like, to foundations or other anchor-type members.

Adjustable columns and structural jacks are well known in the art for use in supporting structures to associated foundation pads and footers. Prior devices of this type have typically included a pair of top and bottom flat rugged plate members connected on either end of an elongate threaded rod and tube arrangement. The bottom base plate member is typically rigidly secured to the tube such as by welding or the like. The tube is disposed in a vertical orientation so that the bottom base plate member engages a concrete footing, flooring, or other firm surface. The threaded rod is normally telescopically received within the tube, the top of the tube being provided with an adjustment nut having internal threads matching the threaded rod. Rotation of the adjustment nut urges the threaded rod in directions along the longitudinal axis of the tube so that, in the above-noted vertical orientation, the adjustable column effectively becomes shorter or taller based upon the direction and number of turns applied to the adjustment nut.

In another form of the above-noted simple single jack system, the threaded rod is intermeshed with mating threads provided in the tube. The rod is rotated into and out from the tube to select the column height. In that construction, the top base plate member of the pair of planar base plate members is rotatably mounted to the top end of the threaded rod to permit relative movement between the plate and the rod. The plate adapts the top end of the column to engage an overhead structural member such as a steel or wooden beam while the rod is rotated relative to a fixed adjustment nut. In both forms of the adjustable column of the type described, axial compressive loads are transferred from the overhead beams to the concrete footers or foundation pads below.

One problem associated with prior adjustable columns, however, resides in the relative inability of the upper base plate member to positively engage the overhead beam without the use of specialized and often hard to use fasteners or the like. Typically, the upper base plate member is provided with a plurality of holes so that lag bolts, nails or other attachment mechanisms can be used to connect the base plate member with the overhead beam. For steel overhead beams, this procedure poses a problem particularly when the use of fastener holes may weaken the structural integrity of the beam.

Proper registration between the fastener holes in the plate member and the holes in the structural steel has also been a problem.

Another problem associated with prior adjustable columns is their inability to resist both negative, i.e. upward, forces tending to separate the supported structure from the foundation base and lateral, i.e. sideways, offsetting forces that tend to horizontally dislodge the supported structure from the associated foundation. Typically, prior art support systems provide either no support against vertical forces or offer only simple straps or lightweight hooks, tabs, or the like. These devices provide inadequate negative resistance and therefore fail to prevent the supported structure from being separated from the foundation base. Further, the lightweight hooks and straps have been found to be inadequate during high intensity weather conditions such as in hurricanes and tornadoes. In those situations, the buildings are often quite easily separated from their foundations or ground anchors resulting in substantial loss of property and often loss of life.

Yet another problem associated with prior adjustable columns is that they are usually difficult to install and set up. More particularly, the hole patterns in the column base plates are often incompatible with the anchor bolt arrangement provided beforehand in the concrete foundation at the job site.

Another setup problem in the prior art support columns described above is their relative inability to adjust lengthwise to any desired height. In that regard, most column jacks use a simple pin-through-hole arrangement wherein the height of the column is determined by multiple discontinuous hole positions along the length of the support column.

Thus, it is desirable to provide an adjustable foundation column of the type described and that includes an adjustable saddle-type positioning member on at least the top end of the column with opposing adjustable wall members for adapting the device to engage and fasten onto a wide range of structural support members of various sizes and shapes.

It is further desirable to provide a fabricated adjustable foundation assembly consisting of adjustable columns, lateral braces, and anchor plates that function as adjustable piers and storm anchors providing substantial positive (downward), negative (upward), and lateral (horizontal) load resistance to supported structures relative to the associated foundation bases in both horizontal and vertical directions.

Still further, it would be desirable to provide a structural anchor system that includes a concrete form plate for use with the associated foundation base as a template to locate associated anchor stud members in the associated foundation base, preferably before the concrete sets, in predetermined arrangements preferably corresponding to a hole pattern on the base of the support column. This would greatly simplify the process of installing the subject support system onto the associated foundation base.

SUMMARY OF THE INVENTION

The subject invention includes an adjustable foundation or basement column of the type described which overcomes the above-noted deficiencies in the prior devices by providing a flexible saddle-type positioning arrangement at the top end of an adjustable foundation column. The saddle area includes a pair of selectively spaced apart wall members that assist in aligning the top column end with the overhead structural beams. The saddle mechanism formed by the wall members is useful to securely fasten the beams at their bottom and sides to the top of the column in a simple fashion.

Further, the subject invention provides a corner anchor system for connecting the corner of an L-shaped elongate frame member on the underside of a structure to an associated foundation base. The corner anchor system includes a first foundation column adapted to be supported on a first end in an upright vertical orientation relative to the associated foundation base and to be selectively held on a second end in a connected relationship with a first elongate section of the L-shaped frame member on the underside of the structure. A first lateral attachment member is selectively held in a connected relationship with the first elongate section of the frame member on the underside of the structure. A first strut member is connected between the first lateral attachment member and the first end of the first foundation column. A second foundation column is provided that is adapted to be supported on a first end in an upright vertical orientation relative to the associated foundation base and to be selectively held on a second end in a connected relationship with a second elongate section of the L-shaped frame member on the underside of the structure. A second lateral attachment member is selectively held in a connected relationship with the second elongate section of the frame member on the underside of the structure. Lastly, a second strut member is connected between the second lateral attachment member and the first end of the second foundation column. Preferably, the first strut member, the first lateral attachment member, and the first foundation column are arranged to define a first plane substantially perpendicular to a second plane defined by the second strut member, the second lateral attachment member, and the second foundation column.

In accordance with another aspect of the invention, a "T-type" anchor system is provided for connecting an elongate frame member integrated into the underside of a structure, such as a mobile home or an article of industrial equipment, to an associated foundation base. The anchor system includes a foundation column adapted to be supported on a first end in an upright vertical orientation relative to the foundation base and to be selectively held on a second end in a connected relationship with the elongate frame member on the underside of the structure. A first lateral attachment member is selectively held in a connected relationship with the elongate frame member on the underside of the structure. A first strut member is connected between the first lateral attachment member and the first end of the foundation column. Similarly, a second lateral attachment member is held in a connected relationship with the elongate frame member on the underside of the structure and a second strut member connects the second lateral attachment member to the first end of the foundation column. Preferably, the foundation column, the first and second lateral attachment members and the first and second strut members are substantially co-planar.

In accordance with yet another aspect of the invention, a "cross-brace type" anchor system is provided for connecting spaced apart frame members on the underside of a structure, such as a mobile home, to an associated foundation base. The anchor system includes a foundation column adapted to be supported on a first end in an upright vertical orientation relative to the associated foundation base and to be selectively held on a second end in a connected relationship with a first one of the spaced apart frame members on the underside of the structure. A lateral attachment member is selectively held in a connected relationship with a second one of the spaced apart frame members on the underside of the structure. Lastly, an elongate transverse rod member connects the lateral attachment member to the first end of the foundation column. The transverse rod member enables the supported structure to withstand horizontal forces in a first direction. In addition to the above, the anchor system includes a longitudinal attachment member selectively held in a connected relationship with the first one of the frame members on the underside of the structure. A longitudinal strut member connects the longitudinal attachment member to the first end of the foundation column. In that way, the supported structure is able to withstand horizontal forces from any direction.

Still yet in accordance with another aspect of the invention, multiple "cross-brace type" anchor systems of the type noted directly above are provided to connect a pair of spaced apart parallel frame members on the underside of a structure, such as a mobile home, to an associated footer, grade beam or foundation pad beneath the structure. That anchor system includes first and second foundation columns adapted to be oriented vertically and selectively held in connected relationships with the first and second spaced apart frame members, respectively. The first foundation column is connected to a first lateral attachment member held on the second frame member by a first elongate transverse rod member. Similarly, the second column is connected to a second lateral attachment member held on the first frame member by a second elongate transverse rod member. The first and second transverse rod members cross at a space beneath the supported structure between the first and second spaced apart frame members. Additionally, first and second longitudinal attachment members are provided on the first and second frame member, respectively. The first longitudinal attachment member is connected to the first column using a first longitudinal strut member. Similarly, the second longitudinal attachment member is connected to the second column using a second longitudinal strut member. In that way, the supported structure e.g. mobile home, is able to withstand substantial positive (downward), negative (upward), and lateral load resistances in both horizontal and vertical directions.

In accordance with yet a further aspect of the invention, a structural anchor system is provided that includes a concrete form plate for use with the associated foundation base as a template to locate associated anchor stud members in the associated concrete base, preferably before the concrete sets, at predetermined positions corresponding to a hole pattern on the bases of the support columns comprising the anchor system.

A primary object of the invention is to provide an anchor system including one or more foundation columns and other lateral and longitudinal attachment members and strut and rod members for supporting a building structure relative to a foundation base.

It is another object of the invention to provide anchor systems of the type described that provide substantial positive, negative, and lateral load resistance to the supported structure in both horizontal and vertical directions.

Yet another object of the invention is the provision of an adjustable saddle-type positioning mechanism on the upper end of an adjustable foundation columns so that they can be easily set up in the field for use with a variety of structural beams having a wide range of dimensions.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof, and wherein.

DETAILED DESCRIPTION OF THE PREFERRED EMBODIMENT

Figure 1:
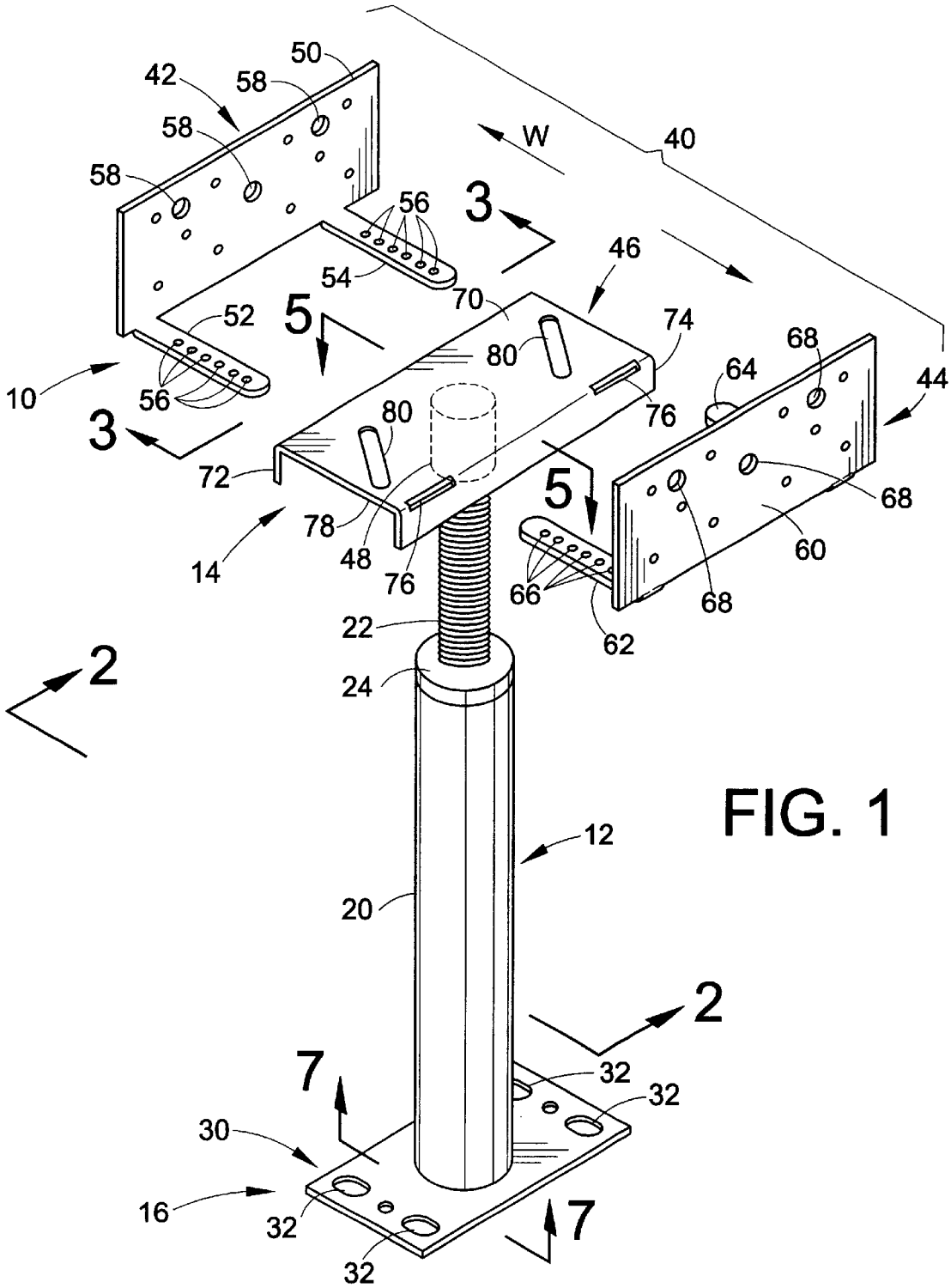
FIG. 1 is an isometric partially exploded view of a single foundation column embodiment of the subject invention shown with the pair of saddle half wall members separated from the upper base plate member.

Referring now to the drawings wherein the showings are for the purposes of illustrating the preferred embodiments of the invention only and not for purposes of limiting same, FIGS. 1–7 show the overall arrangement of an improved foundation column with adjustable saddle-type positioning members formed in accordance with a first, referred embodiment of the subject invention.

Turning now to those FIGURES, the improved foundation column 10 includes an elongate main body portion 12 which is preferably vertically oriented as illustrated to best transfer axial compressive and tensional loads between steel or wood beams engaged with the top end 14 to concrete footings or the like engaged with the bottom end 16 of the column. In its preferred form, the elongate main body portion 12 includes an elongate substantially cylindrical support tube 20 adapted to coaxially telescopically receive a threaded rod member 22 therein as illustrated. In that way, the length of the column is adjustable.

An internally threaded adjustment member 24 is rotatably supported on the top end of the support tube 20 in a well known manner using bearings or the like. The adjustment member 24 is preferably disk shaped as shown and is provided with internal threads configured to match the pitch and size of the external threads on the threaded rod member 22. Rotation of the adjustment member 24 in a first direction causes the threaded rod member 22 to be urged outwardly from the support tube 20 and, conversely, rotation of the adjustment member 24 in an opposite direction causes the threaded rod member 22 to be retracted telescopically within the support tube 20.

The bottom end 16 of the adjustable column portion 12 preferably includes a base plate member 30 which is rigidly attached to the support tube 20 by well known means such as welding, for example. The base plate member 30 is provided with a plurality of connection holes 32 adapted to receive a set of suitable fasteners (not shown) therethrough. The fasteners are typically used to firmly attach the bottom end 16 of the subject foundation column 10 to concrete footings, floorings, and the like.

The top end 14 of the adjustable column 12 forms an upper attachment end 40 which preferably includes left and right wall members 42, 44 and an intermediate top plate member 46. The top cap plate member 46 is formed as a flat cap plate member and is rigidly attached to an elongate substantially cylindrical engagement sleeve member 48 as shown. The sleeve member is internally threaded to connect to the rod 22. The orientation and general arrangement of the components forming the upper attachment end of the first preferred embodiment are best illustrated in FIGS. 1 and 2.

The left wall member 42 includes a beam engagement member 50 having a pair of elongate connection tabs 52, 54 extending substantially perpendicular therefrom as illustrated. Similarly, the right wall member 44 includes a second beam engagement member 60 having a pair of connection tabs 62, 64 extending substantially perpendicular therefrom as shown. For reasons that will subsequently become apparent, the left and right wall members are preferably identically formed and disposed at the attachment end 40 in an opposed mirror image relationship.

Figure 2:
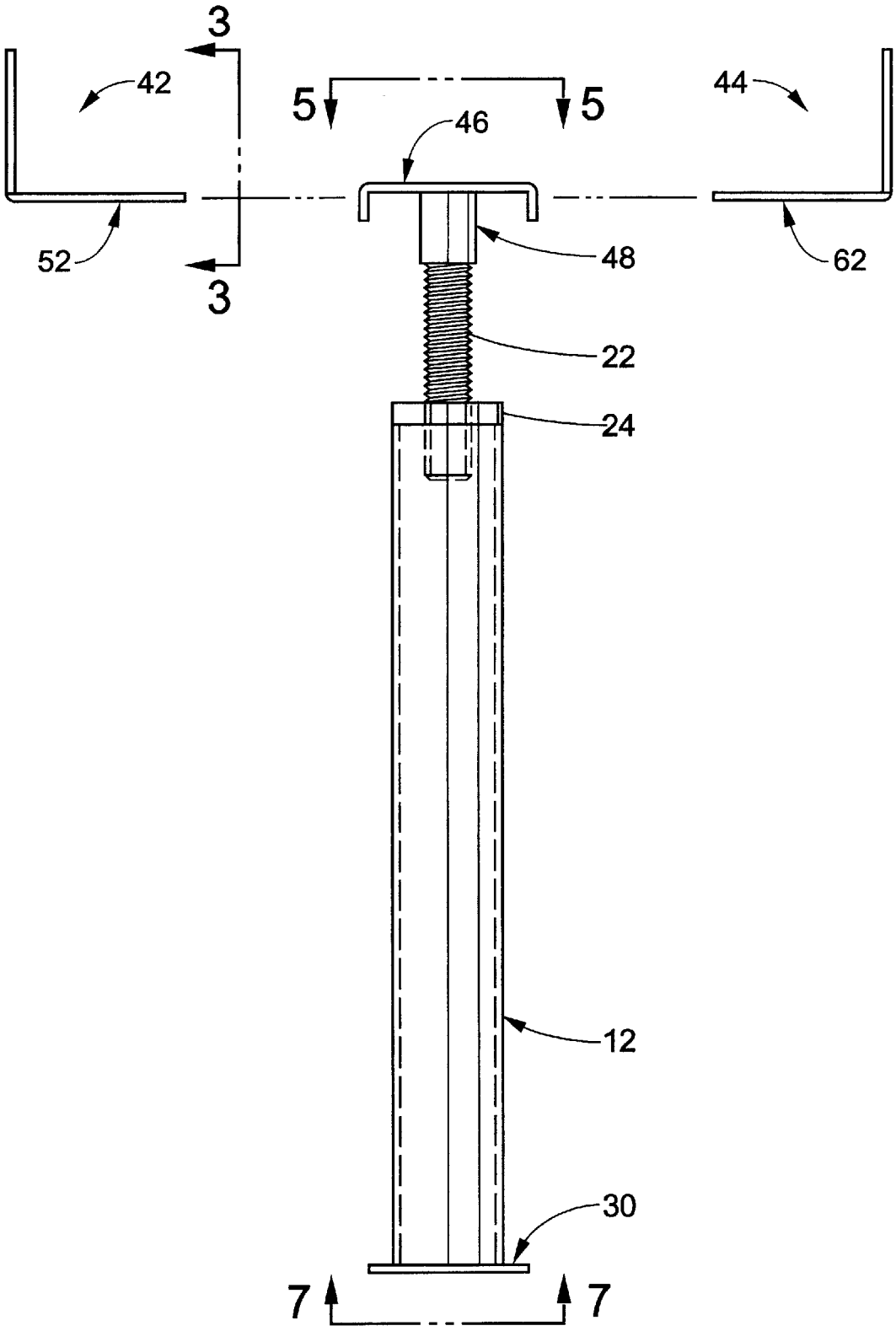
FIG. 2 is a side elevational view of the adjustable column of FIG. 1 taken on line 2—2.
Figure 3:
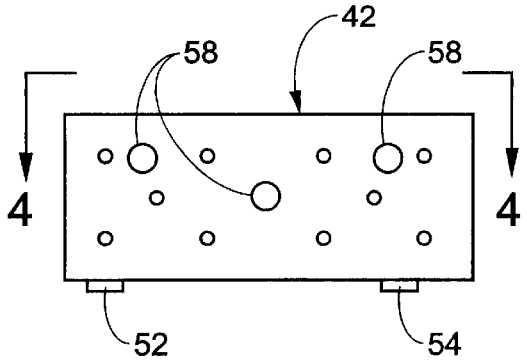
FIG. 3 is a side elevational view showing a saddle member of the foundation column shown in FIG. 1 taken on line 3—3 of FIG. 2.
Figure 5:
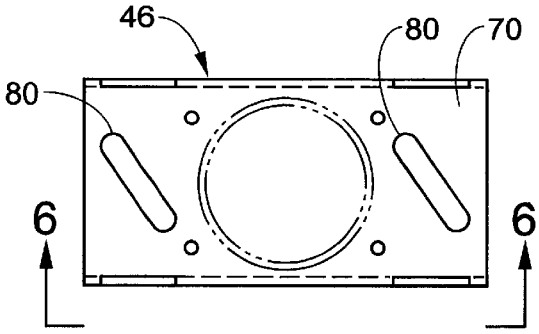
FIG. 5 is a top plan view showing the top plate member of the foundation column shown in FIG. 1 taken on line 5—5 of FIG. 2.
Figure 4:
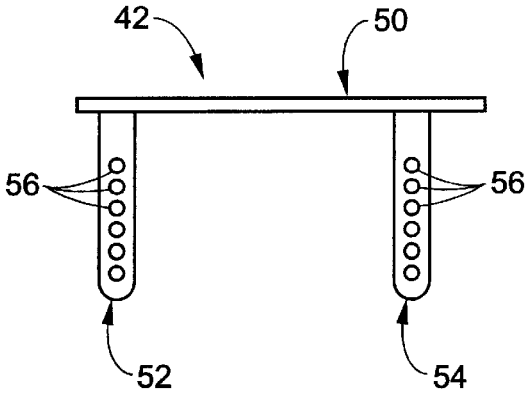
FIG. 4 is a top plan view of the saddle half member shown in FIG. 3 and taken on line 4—4 of FIG. 3.
Figure 6:
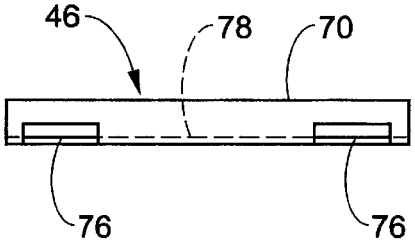
FIG. 6 is a side elevational view showing the top plate member of the foundation column shown in FIG. 1 taken on line 6—6 of FIG. 5.
Figure 7:
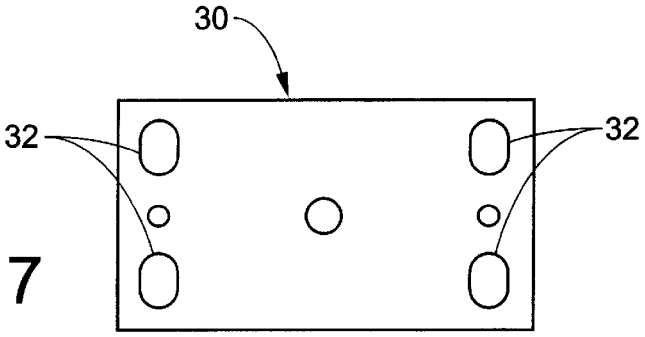
FIG. 7 is a bottom plan view showing the base plate member of the foundation column shown in FIG. 1 taken on line 7—7 of FIG. 2.

The top cap plate member 46 includes a top substantially planar surface 70 and a pair of vertically oriented lip edges 72, 74 which are curled in a downward direction best illustrated in FIGS. 2 and 6. The lip edges 72, 74 include a set of side openings 76 which are adapted to receive the first and second sets of connection tabs 52, 54 and 62, 64 therethrough, respectively.

Preferably, the connection tab pairs extend through the side openings 76 of the top plate member 46 so that they overlap adjacent the underside 78 of the top plate member 46 near a pair of spaced apart diagonal attachment apertures 80. A first set of holes 56 are provided in the first set of connection tabs 52, 54 and a second set of holes 66 provided in the second set of connection tabs 62, 64 as shown. In the overlapped position, some of the first set of holes 56 register with some of the second set of holes 66. Further, some of the first and second sets of holes 56, 66 register with the pair of diagonal attachment apertures 80. The above-noted hole registration enables the mutual interconnection of the tabs adjacent the underside 78 of the top plate member using suitable threaded fasteners that extend through the holes and apertures into the structural beam resting on the top plate member 46.

The left wall member 42 is preferably provided with a set of spaced apart attachment openings 58 to accommodate various fasteners used to connect the left wall member with a vertical face of a structural beam. Similarly, the right wall member 44 is provided with a set of spaced apart attachment openings 68 arranged substantially as shown.

In use, the left and right wall members 42, 44 are selectively adjustable in the direction labeled W in FIG. 1 to accommodate a wide range of beam widths. The range of adjustability spans from a minimum size corresponding to the width of the top plate member 46 whereat the wall members are disposed in contact against the lip edges 72, 74, to a maximum wide opening at a position substantially separated from the top plate member. The maximum separation between the inner face surfaces of the wall members is limited only by the length of the elongate connection tabs 52, 54 and 62, 64.

Figure 8:
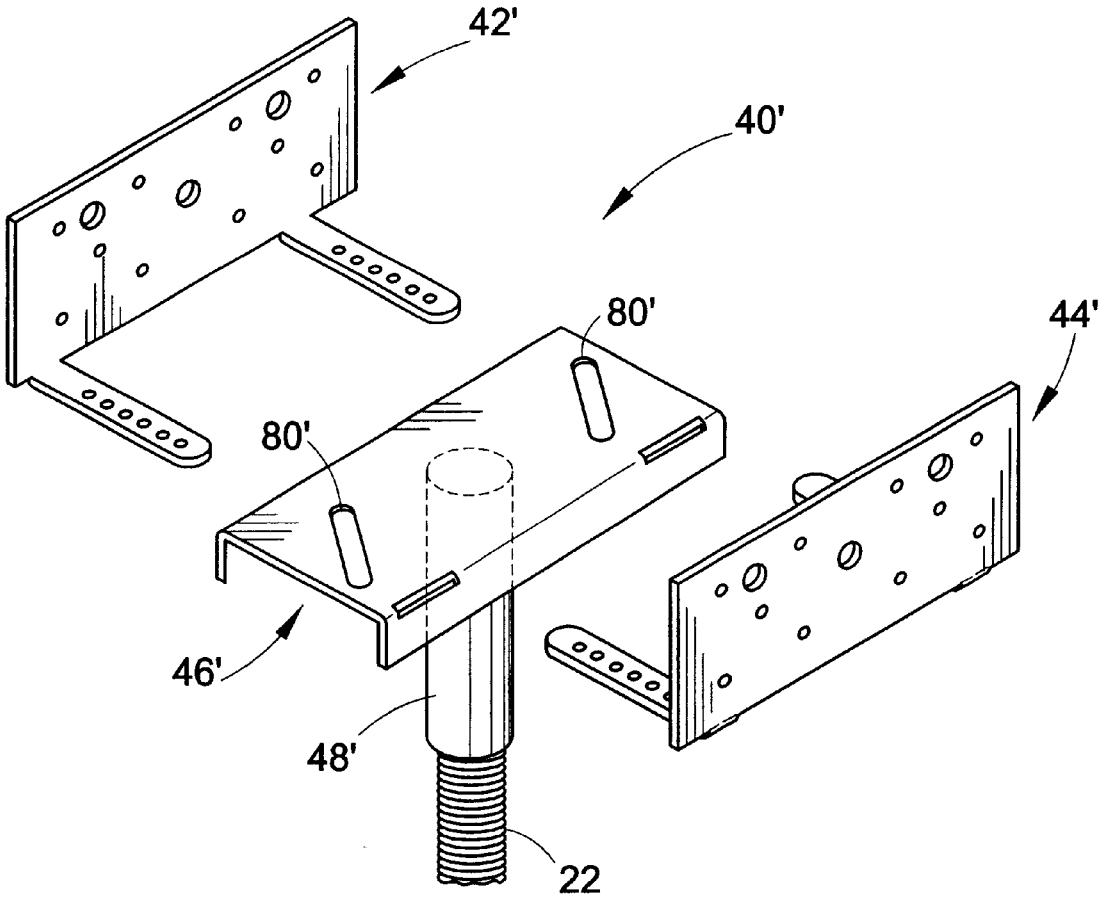
FIG. 8 is an isometric view showing an alternative embodiment of the single foundation column according to the present invention.

Turning now to. FIG. 8, an alternative arrangement of the subject adjustable foundation column is illustrated. As shown there, the upper attachment end 40' includes a left member 42', a right wall member 44', and a top cap plate member 46'. The top plate member 46' is rigidly attached to an elongate substantially cylindrical engagement sleeve member 48 as shown. The engagement sleeve has an internal diameter slightly larger than the outside diameter of the threaded rod member 22 so that the entire upper attachment end 40' is rotatable on the threaded rod member. This feature of the alternative arrangement adapts the upper attachment end 42' to be useful with a plurality of adjustable column portions and is especially useful with adjustable column portions wherein rotation of the threaded rod member causes extension and retraction of the cooperating members.

Figure 9:
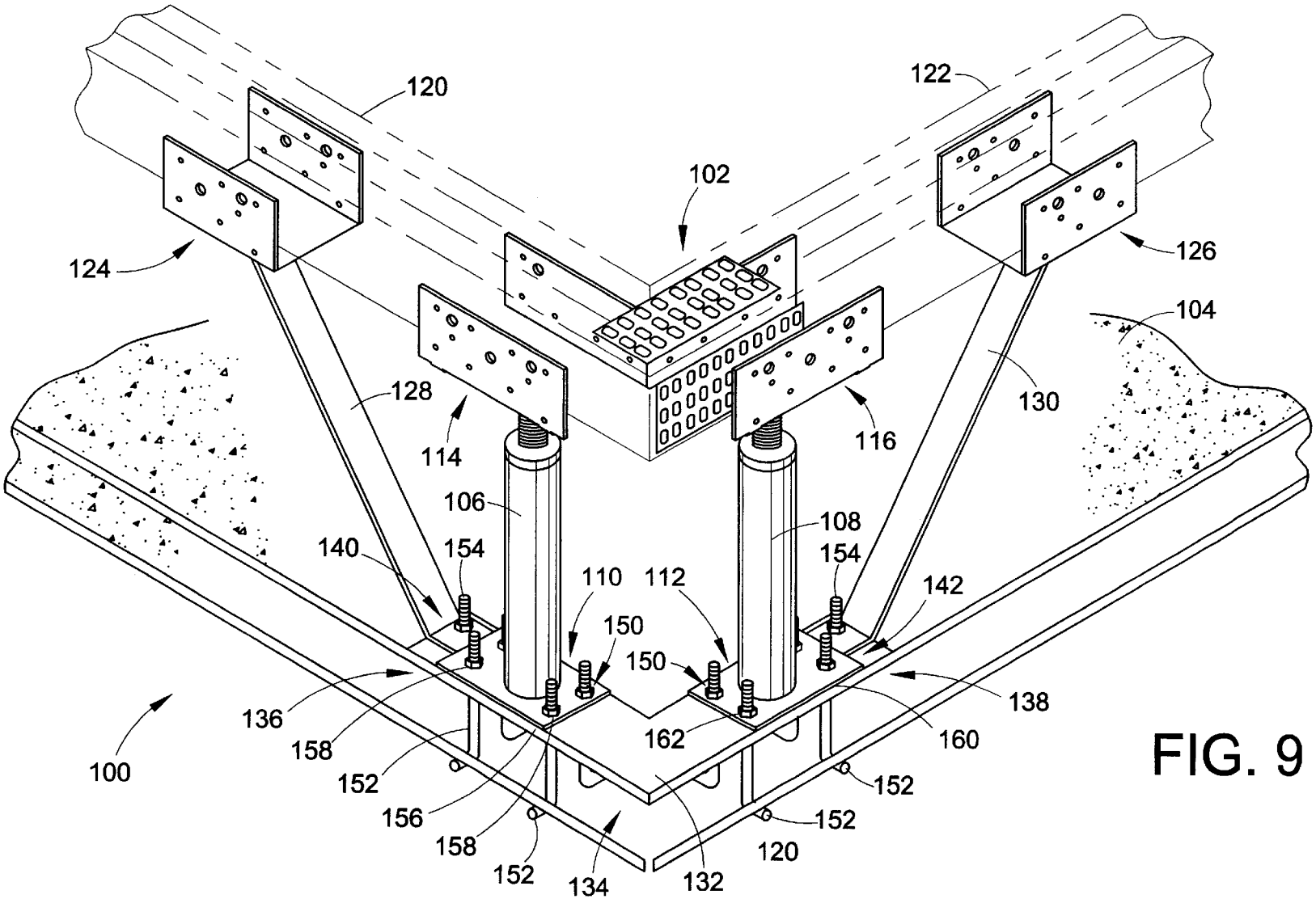
FIG. 9 is an isometric illustration showing a corner anchor system formed in accordance with a second embodiment of the invention.

Turning next to FIG. 9, a corner anchor system 100 in accordance with the second preferred embodiment of the invention is illustrated for connecting the corner of an L-shaped elongate frame member 102 integrated into the underside of a structure (not shown) to an associated foundation base 104. As shown, the corner anchor system 100 preferably includes first and second foundation columns 106, 108 generally of the type described above. The first foundation column 106 is adapted to be supported on a first end 110 in an upright vertical orientation relative to the associated foundation base 104. Similarly, the second foundation column 108 is vertically oriented and engages the foundation base 104 on a first end 112. The second end 114 of the first foundation column 106 is selectively held in a connected relationship with a first elongate section 120 of the L-shaped frame member 102 as shown. In its preferred form, the second end 114 of the first foundation column includes a pair of movable wall members that are formed and function in a manner as described above in connection with the first embodiment. Similarly, the second end 116 of the second foundation column 108 is selectively held in a connected relationship with a second elongate section 122 as shown. As can be seen, the second end 116 preferably also includes a pair of movable wall members that are formed and function in a manner described above.

With continued reference to FIG. 9, the corner anchor system 100 preferably includes at least one set of first and second lateral attachment members 124, 126 that are each held in a connected relationship with the first and second elongate sections 120, 122, respectively, of the L-shaped frame member 102. Preferably as shown, the first and second lateral attachment members 124, 126 are formed and function in a manner described above in connection with the top end 14 of the foundation column 10.

A first strut member 128 is disposed in a diagonal orientation as shown for connecting the first lateral attachment member 124 relative to the first end 110 of the first foundation column 106. Similarly, a second strut member 130 is provided for connecting the second lateral attachment member 126 relative to the first end 112 of the second foundation column 108.

As can be seen in the FIGURE, the first strut member, together with the first lateral attachment member and the first foundation member are arranged to substantially define a first plane. Likewise, the second strut member together with the second lateral attachment member and the second foundation member are arranged to define a second plane. In the square corner illustrated, the first and second planes are substantially perpendicular to each other. It is to be appreciated, however, that the subject corner anchor system 100 is equally well suited for use in structural corners that do not intersect at precise perpendicular planes. To that end, the corner anchor system 100 is shown in its preferred form by way of example only in a right angled corner.

Figure 10:
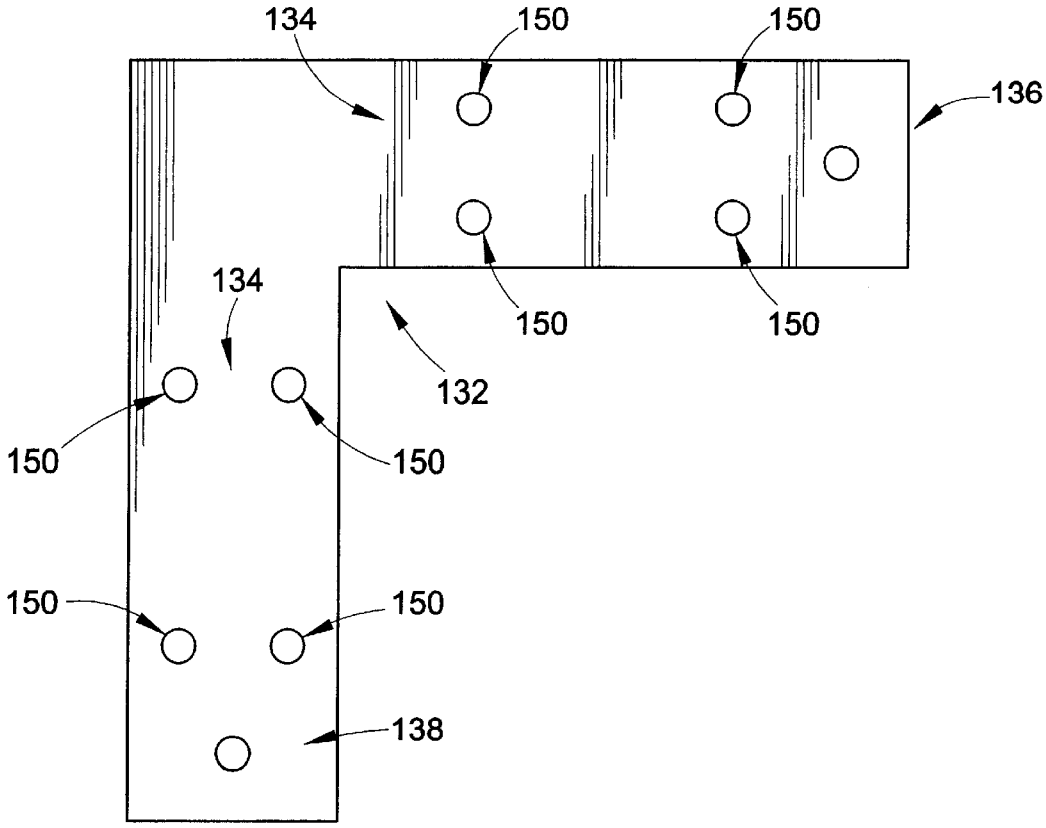
FIG. 10 is a top plan view showing the foot plate member of the corner anchor system of FIG. 9 used as an anchor stud template.

With yet continued reference to FIG. 9 and with additional reference to FIG. 10, the subject corner anchor system 100 further includes a foot plate member 132 interposed between the associated foundation base 104 and the first ends 110, 112 of the first and second foundation columns 106, 108, respectively. In its preferred form, the foot plate member 132 is substantially planar and has an outer edge pattern shaped to match the top surface of the associated foundation base 104. As shown in the FIGURES, the foot plate member is L-shaped to match the right angled corners formed by the foundation base 104 and the frame member 102.

Generally, the foot plate member 132 is adapted on a bottom surface to engage the associated foundation base 104 and includes a central connection area 134 for selectively receiving the first ends 110, 112 of the first and second foundation columns 106, 108, as shown. Further, the foot plate member 132 also includes first and second lateral connection areas 136, 138 on opposite ends of the foot plate member for selectively receiving a lower attachment end 140 of the first strut member 128 and a second lower attachment end 142 of the second strut member 130, respectively.

In order to provide a means for securely attaching the subject corner anchor system to the associated foundation base, the central connection area 134 of the L-shaped foot plate member 132 includes a first plurality of holes 150 that are adapted to receive a corresponding first set of associated anchor stud members 152 as shown. The anchor stud members 152 therethrough are held fixed on one end in the associated foundation base 104 and include an upper threaded region 154 adapted for use with a set of locking nuts to cooperatively selectively fasten the foot plate member 132 onto the associated foundation base 104.

One major advantage of the L-shaped foot plate member 132 of the present invention is that it is usable as a template for locating the associated anchor stud members 152 in the associated foundation base 104 before the concrete base dries in a predetermined arrangement, preferably the arrangement illustrated in FIGS. 9 and 10. In that way, installation of the subject corner anchor system is made easy because the anchor stud members are pre-arranged in locations that enable connection of the foundation columns 106, 108 and the strut members 128, 130 directly onto the studs without modification. To that end, the first end 110 of the first foundation column 106 includes a substantially planar first base plate 156 adapted to engage the central connection area 134 of the L-shaped foot plate member 132 as shown (FIG. 9). The first base plate 156 is provided with a second plurality of holes 158 disposed at locations corresponding to the predetermined arrangement of the first plurality of holes 150 formed in the foot plate member 132. Similarly, the first end 112 of the second foundation column 108 includes a substantially planar second base plate 160 adapted to engage the central connection area 134 of the L-shaped foot plate member 132 as shown. The second base plate 160 includes a third plurality of holes 162 disposed at locations corresponding to the arrangement of the first plurality of holes 150 formed in the foot plate member 132.

Preferably, the upper threaded regions 154 of the first set of anchor stud members 152 extend upwardly from the foundation base 104 through the first, second, and third plurality of holes formed in the foot plate member 132 and the first and second base plates 156, 160 to enable the first and second foundation columns to be fastened onto the associated foundation base 104 together with the L-shaped foot plate member in a stacked relationship.

Figure 11:
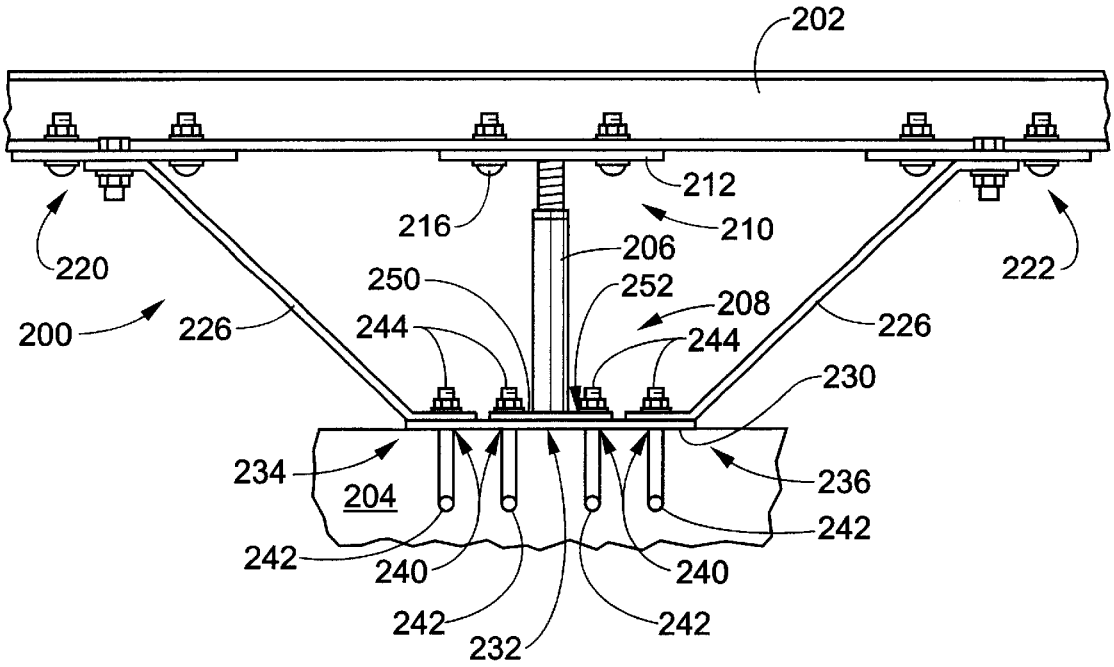
FIG. 11 is a side elevational view of a "T-type" anchor system formed in accordance with a third embodiment of the invention for connecting a single elongate frame member to a foundation.

A "T-type" anchor system 200 is illustrated at FIG. 11 for connecting a single elongate frame member 202 integrated into the underside of a structure (not shown) to an associated foundation base 204. In its preferred form, the anchor system 200 includes a foundation column 206 adapted to be supported on a first end 208 in an upright vertical orientation relative to the associated foundation base 204 and to be selectively held on a second end 210 in a connected relationship with the elongate frame member 202 as shown.

Figure 12:
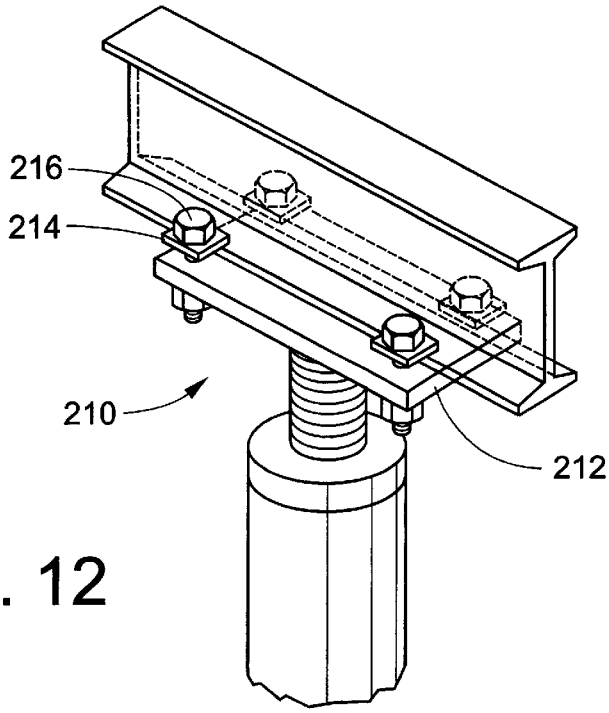
FIG. 12 is an elevated perspective view of a lateral attachment member of the type used in the third embodiment shown in FIG. 11.

Although the anchor system 200 illustrated in FIG. 11 has many uses, it is particularly well adapted for use in connection with supporting mobile homes and prefabricated home constructions on concrete footers. To that end, as shown in FIG. 12, the second end 210 of the anchor system 200 includes a substantially planar cap plate member 212 that is adapted to carry a set of clamp members 214 at the outer corners of the cap plate member as shown. Cap plate members of the type shown are well known in the art. Generally, they function by grasping the flanges of structural steel between the clamping members and the outer surface of the clamp plate member. The clamp members are urged together using a set of fasteners 216 such a nuts and bolts, or the like.

With reference back again to FIG. 11, the subject "T-type" anchor system 200 further includes first and second lateral attachment members 220, 222 that are each selectively held in a connected relationship with the elongate frame member 202 as shown. A first strut member 224 extends diagonally between the first lateral attachment member 220 and the first end 208 of the foundation column 206. Similarly, a second strut member 226 extends diagonally to connect the second lateral attachment member 222 relative to the first end 208 of the foundation column 206.

Figure 13:
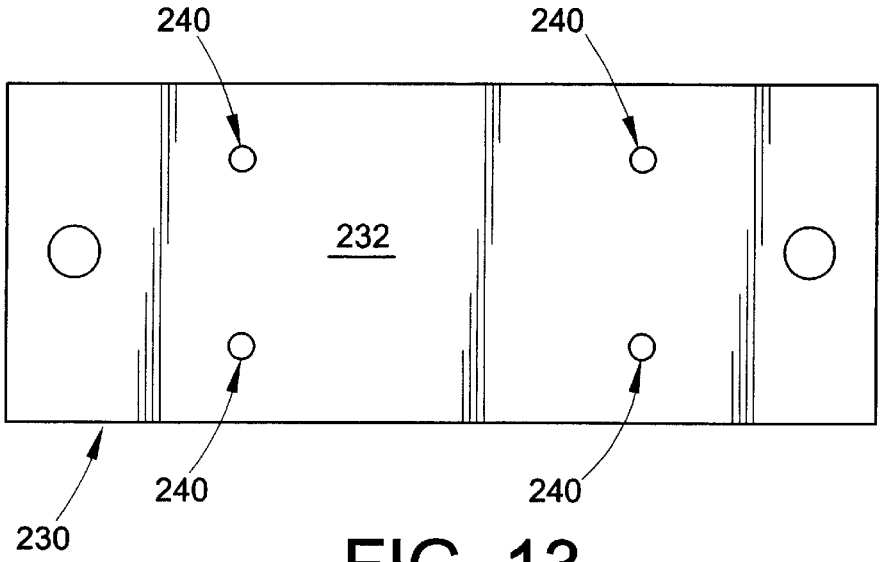
FIG. 13 is a top plan view showing the foot plate member of the "T-type" anchor system of FIG. 11 used as an anchor stud template; and, FIG. 14 is an elevated isometric view in partial phantom illustrating a "cross-brace type" anchor system in accordance with a fourth embodiment of the invention for connecting a pair of spaced apart parallel frame members of a structure to an associated foundation.

With continued reference to FIG. 11 and with additional reference to FIG. 13, the "T-type" anchor system 200 of the third preferred embodiment shown includes a substantially planar foot plate member 230 adapted on a bottom surface to engage the associated foundation base 204. The foot plate member 230 includes a central connection area 232 for selectively receiving the first end 208 of the foundation column 206 and first and second lateral connection areas 234, 236 on opposite sides of the central connection area 232. The first and second lateral connection areas are adapted for selectively receiving the lower ends of the first and second strut member 224, 226, respectively.

The central connection area 232 of the foot plate member 230 includes a first plurality of holes 240 spaced apart in a preferred predetermined arrangement as shown. The first plurality of holes are adapted to receive a first set of associated anchor stud member 242 held fixed on one end in the associated foundation base 204. The free ends 244 of the anchor stud members 242 are preferably threaded and extend through the first plurality of holes 240 formed in the foot plate member 230 as shown. In that way, the foot plate member can be selectively fastened to the foundation base. As noted above in connection with the second embodiment of the invention, the foot plate member 230 is useful as a template for locating the associated anchor stud members 242 in the associated foundation base in a variety of predetermined arrangements.

Lastly in connection with FIGS. 11–13, the first end 208 of the foundation column 206 includes a substantially planar base plate 250 adapted to engage the central connection area 232 of the foot plate member 230. The base plate 250 is provided with a second plurality of holes 252 disposed at locations corresponding to the predetermined arrangement of the first plurality of holes 240 on the foot plate member 230 so that the free ends 244 of the anchor stud members 242 can extend through both the foot plate member 230 and the base plate 250. In that way, the foundation column 206 can be easily connected onto the foundation base 204 together with the foot plate member 230 in a stacked relationship.

Figure 14:
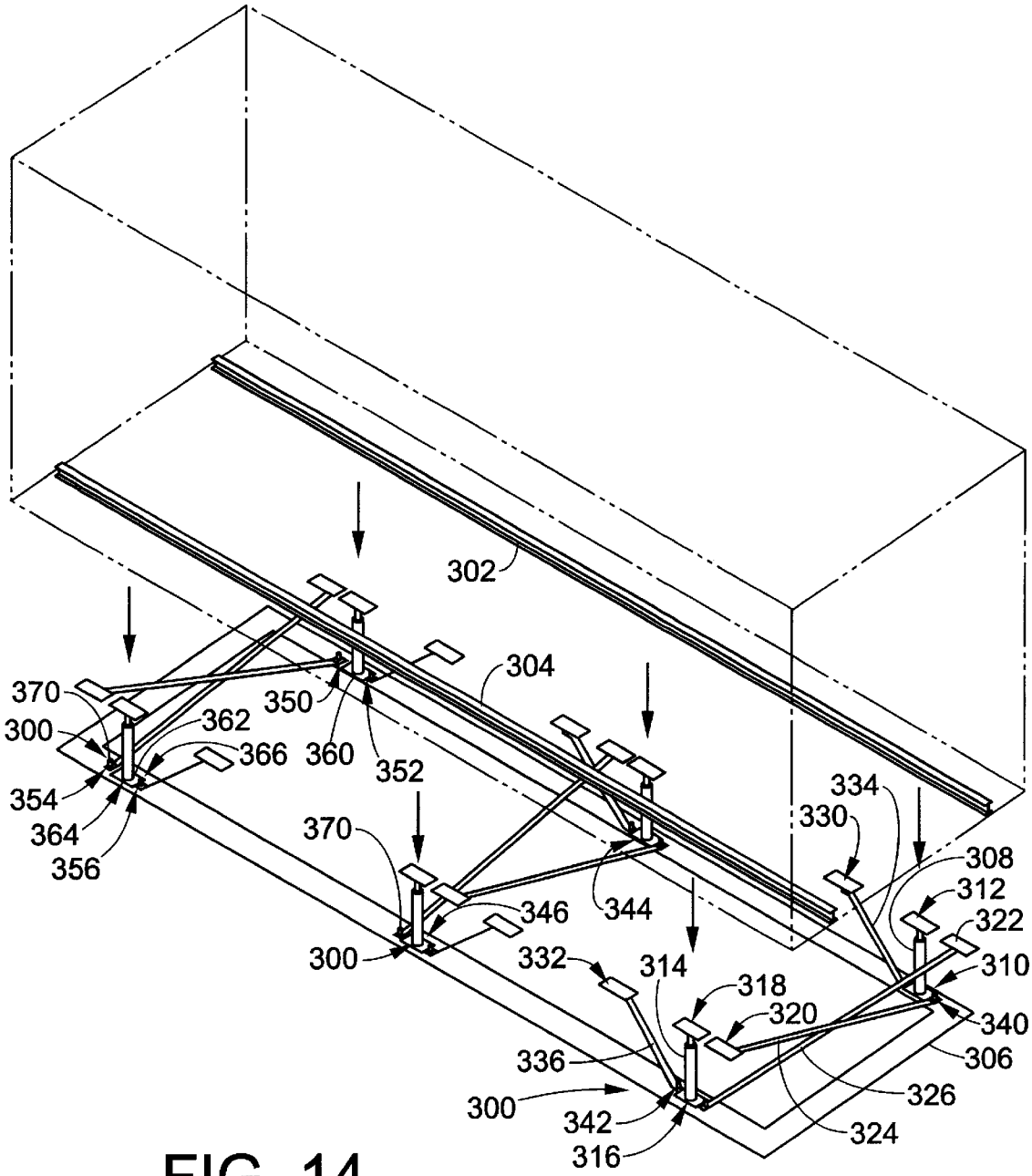

FIG. 14 illustrates a "cross-brace type" anchor system 300 for connection a pair of spaced apart parallel frame members 302, 304 on the underside of a structure (not shown) to an associated foundation base 306. Although the anchor system 300 shown in the drawing has many uses, it is particularly well suited for use in connecting mobile homes or trailers onto a foundation support and will be described with particular reference thereto.

The anchor system 300 includes a first foundation column 308 adapted to be supported on a first end 310 in an upright vertical orientation relative to the associated foundation base 306 and to be selectively held on a second end 312 in a connected relationship with a first one 302 of the parallel frame members.

A second foundation column 314 is provided and is supported on a first end 316 in an upright vertical orientation relative to the associated foundation base 306 and is selectively held on a second end 318 in a connected relationship with the second frame member 304. A first lateral attachment member 320 is selectively held in a connected relationship with the second frame member 304. Conversely, a second lateral attachment member 322 is selectively held in a connected relationship with the first frame member 302. The first lateral attachment member 320 is connected to the first foundation column 308 using a first elongate transverse rod member 324 as shown. Similarly, a second elongate transverse rod member 326 is used to connect the second lateral attachment area 322 to the first end 316 of the second foundation column 314.

A first longitudinal attachment member 330 is held in a connected relationship with the first frame member 302 as shown. Similarly, a second longitudinal attachment member 332 is connected to the second frame member 304. A first longitudinal strut member 334 extends diagonally to connect the first longitudinal attachment member 330 to the first end 310 of the first foundation column 308. Likewise, a second longitudinal strut member 336 connects the second longitudinal attachment member 332 to the first end 316 of the second foundation column 314.

One advantage of the "cross-brace type" anchor system 300 shown in FIG. 14 is that a very rigid support system is provided. In that regard, the structure supported on the anchor system 300 is substantially immune from offsetting forces in upward, downward, and horizontal directions. The orthogonality of the components comprising the anchor system 300 substantially contributes to the rigidity of the system. In that regard, the first longitudinal strut member 334, the first longitudinal attachment member 330, and the first foundation column 308 are arranged to define a first plane. Similarly, the second longitudinal strut member 336, the second longitudinal attachment member 332, and the second foundation column 314 are arranged to define a third plane. A second plane is defined by the first elongate transverse rod member 324, the first lateral attachment member 320, and the first foundation column 308. A fourth plane is defined by the second elongate transverse rod member 326, the second lateral attachment member 322, and the second foundation column 314.

In accordance with the preferred form of the fourth embodiment illustrated in FIG. 14, the first and second planes defined by the respective components are mutually perpendicular with each other. Similarly, the third and fourth planes are mutually perpendicular with each other. In that way, the anchor system can withstand severe lateral forces in a horizontal plane in any direction.

A first substantially planar foot plate member 340 is provided for interfacing the first foundation column 308 with the associated foundation base 306. Similarly, a second foot plate member 342 is provided for interfacing the second foundation column 314 with a foundation base 306.

In their preferred form, the first and second foot plate members 340, 342 include central connection areas 344, 346, respectively. The first foot plate member 340 includes first and second lateral connection areas 350, 352 on opposite sides of the central connection area 344. Similarly, the second foot plate member 342 includes first and second lateral connection areas 354, 356 on opposite sides of the central connection area 346. The foot plate members 340, 342 are formed and function substantially in the manner described above in connection with the corner anchor system and the "T-type" anchor system.

In order to secure the anchor system 300 onto the associated foundation base 306, the first and second foundation columns 308, 314 are provided with a substantially planar base plate 360, 362, respectively. The base plates are provided with a set of holes 364 disposed in a pattern corresponding to a second set of holes 366 formed in the first and second plate members 340, 342. In that way, the free ends of a set of anchor stud members 370 can pass freely through the plate members and the base plate members for connecting a first and second foundation columns, together with the lower ends of the longitudinal strut members and transverse rod members onto the associated foundation base 306.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A foundation column for supporting associated housing structures having various sizes relative to an associated foundation base, the foundation column comprising:

an elongate main body member defining a longitudinal axis and having a base end adapted to be held in a fixed relation on the associated foundation member and an upper interface end opposite from the base end;

a substantially flat cap plate member disposed on the upper interface end of the main body member in a plane substantially perpendicular with the longitudinal axis, the cap plate member having an upper face surface adapted to engage the associated housing structure from below and prevent relative movement between the housing structure and the foundation base in directions along said longitudinal axis; and, a pair of spaced apart wall members carried by the cap plate member on opposite sides of the longitudinal axis, the pair of wall members being selectively movable relative to the cap plate member to receive associated housing structures of various sizes in the space between the pair of wall members, each of said pair of wall members including at least one tab member extending from a respective lower edge of the wall member, the at least one tab member of a first of said pair of wall members overlapping the at least one tab member of a second of said pair of wall members adjacent a lower face surface of the cap plate member opposite said upper face surface.

2. The foundation column according to claim 1 wherein the pair of wall members are adapted to clamp the housing structure between the pair of wall members to prevent relative movement between the upper interface end of the elongate main body member and the associated housing structure.

3. The foundation column according to claim 2 wherein the pair of wall members are adapted to be selectively fastened to the cap plate member to prevent said relative movement between the pair of wall members and the cap plate member.

4. The foundation column according to claim 3 wherein the pair of wall members are adapted to be selectively fastened directly to the associated housing structure to prevent said relative movement between the upper interface end of the elongate main body member and the associated housing structure.

5. The foundation column according to claim 4 wherein the cap plate member includes a pair outer lip members formed on edges of the cap member and extending away from the plane of the cap plate member, the outer lip members defining a first pair of slots adapted to slidably receive the tab members extending from the pair of wall members.

6. The foundation column according to claim 5 wherein the cap plate member includes at least one access opening located at a position on the cap plate member to allow access to the tab members through the opening to permit the tab members to be attached to the associated housing structure.

7. The foundation column according to claim 1 further comprising a substantially planar foot plate member adapted on a bottom surface to engage said associated foundation base and including a central connection area for selectively receiving the base end of the main body member on the foot plate member, the foot plate member including a first plurality of holes spaced apart in a predetermined arrangement, the first plurality of holes being adapted to receive a first set of associated anchor stud members held fixed on one end in the associated foundation base for selectively fastening the foot plate member to the associated foundation base.

8. The foundation column according to claim 7 wherein the base end of the main body member includes a substantially planar base plate adapted to engage the central connection area of the foot plate member, the base plate being provided with a second plurality of holes disposed at locations corresponding to said predetermined arrangement of the first plurality of holes on the foot plate member for selectively fastening the base plate together with the foot plate member onto the associated foundation base in a stacked relationship.

9. The foundation column according to claim 8 wherein the substantially planar base plate is adapted for use as a template for locating said associated anchor stud members in the associated foundation base in said predetermined arrangement.

10. The foundation column according to claim 1 wherein the pair of wall members are adapted to be selectively fastened to the cap plate member to prevent relative movement between the pair of wall members and the cap plate member.

11. The foundation column according to claim 1 wherein the pair of wall members are adapted to be selectively fastened directly to the associated housing structure to prevent relative movement between the upper interface end of the elongate main body member and the associated housing structure.

12. The foundation column according to claim 1 wherein the cap plate member includes a pair of outer lip members formed on edges of the cap member and extending away from the plane of the cap plate member, the outer lip members defining a first pair of slots adapted to slidably receive the tab members extending from the pair of wall members.

13. A foundation column for supporting associated housing structures having various sizes relative to an associated foundation base, the foundation column comprising:

an elongate main body member defining a longitudinal axis and having a base end adapted to be held relative to the associated foundation member and an upper interface end opposite from the base end;

a substantially flat cap plate member disposed on the upper interface end of the main body member, the cap plate member having opposite upper and lower face surfaces, the upper face surface being adapted to engage the associated housing structure from below and prevent relative movement between the housing structure and the foundation base; and, a pair of spaced apart wall members carried by the cap plate member on opposite sides of the longitudinal axis, the pair of wall members being selectively movable relative to the cap plate member to receive associated housing structures of various sizes in the space between the pair of wall members, each of said pair of wall members including at least one tab member, the at least one tab member of a first one of said pair of wall members overlapping the at least one tab member of a second one of said pair of wall members adjacent said lower face surface of the cap plate member.

14. The foundation column according to claim 13 wherein the pair of wall members are adapted to clamp the housing structure between the pair of wall members to prevent relative movement between the upper interface end of the elongate main body member and the associated housing structure.

15. The foundation column according to claim 13 wherein the pair of wall members are adapted to be selectively fastened to the cap plate member to prevent relative movement between the pair of wall members and the cap plate member.

16. The foundation column according to claim 13 wherein the pair of wall members are adapted to be selectively fastened directly to the associated housing structure to prevent relative movement between the upper interface end of the elongate main body member and the associated housing structure.

17. The foundation column according to claim 13 wherein the cap plate member includes a pair outer lip members formed on edges of the cap member and extending away from the plane of the cap plate member, the outer lip members defining a first pair of slots adapted to slidably receive the tab members extending from the pair of wall members.

18. A foundation column for supporting an associated housing structure relative to an associated foundation base, the foundation column comprising:

an elongate main body member defining a longitudinal axis and having a base end adapted to be held relative to the associated foundation member and an upper interface end opposite from the base end;

a substantially flat cap plate member disposed on the upper interface end of the main body member, the cap plate member defining at least one slot and having opposite upper and lower face surfaces, the cap plate member being above the base end and the upper face surface being adapted to engage the associated housing structure and prevent relative movement between the housing structure and the foundation base; and, a pair of spaced apart wall members carried by the cap plate member on opposite sides of the longitudinal axis, the pair of wall members being selectively movable relative to the cap plate member to receive the associated housing structure in the space between the pair of wall members, each of said pair of wall members including at least one tab member extending beneath and adjacent to said lower face surface of the cap plate member and into said at least one slot, wherein the wall members are adapted to be movable with the associated housing structure resting on said upper face surface.

19. The foundation column according to claim 18 wherein the pair of wall members are adapted to clamp the housing structure to prevent relative movement between the upper interface end of the elongate main body member and the associated housing structure in a direction transverse said longitudinal axis.

20. The foundation column according to claim 18 wherein the pair of wall members are adapted to be selectively fastened to the cap plate member to prevent relative movement between the pair of wall members and the cap plate member.

21. The foundation column according to claim 18 wherein the pair of wall members are adapted to be selectively fastened directly to the associated housing structure to prevent relative movement between the upper interface end of the elongate main body member and the associated housing structure.

22. The foundation column according to claim 18 wherein the cap plate member includes a pair outer lip members formed on edges of the cap member and extending away from a plane of the cap plate member defined by said upper face surface, the pair of slots being formed in said pair of outer lip members of said cap plate member.

23. The foundation column according to claim 18 wherein the at least one tab member of a first one of said pair of wall members overlaps the at least one tab member of a second one of said pair of wall members adjacent said lower face surface of the cap member.

* * * * *